United States Patent [19]

Reich

[11] 4,196,814

[45] Apr. 8, 1980

[54] VERTICAL TELESCOPING LOWER CRANE

[75] Inventor: Elmar Reich, Schmelzweg, Fed. Rep. of Germany

[73] Assignee: E. H. Hans Liebherr, Riss, Fed. Rep. of Germany

[21] Appl. No.: 939,868

[22] Filed: Sep. 5, 1978

Related U.S. Application Data

[63] Continuation of Ser. No. 760,691, Jan. 19, 1977, abandoned, which is a continuation of Ser. No. 547,446, Feb. 6, 1975, abandoned.

[30] Foreign Application Priority Data

Feb. 8, 1974 [DE] Fed. Rep. of Germany ..... 2406183

[51] Int. Cl.[2] ..... B66C 23/62; B66C 23/06

[52] U.S. Cl. ..... 212/46 B; 212/57; 212/64; 212/144

[58] Field of Search ..... 212/33-34, 212/46 B, 55-57, 28, 61-65, 144

[56] References Cited

U.S. PATENT DOCUMENTS

| | | | |
|---|---|---|---|
| 1,788,451 | 1/1931 | Clapp | 212/64 |
| 2,676,388 | 4/1954 | Favie et al. | 212/46 R |
| 3,656,631 | 4/1972 | Rauch et al. | 212/57 |
| 3,672,115 | 6/1972 | Abe et al. | 212/46 B |
| 3,894,635 | 7/1975 | Reich | 212/46 B |

FOREIGN PATENT DOCUMENTS

| | | | |
|---|---|---|---|
| 1082022 | 5/1960 | Fed. Rep. of Germany | 212/46 B |
| 1925578 | 1/1970 | Fed. Rep. of Germany | 212/64 |
| 64233 | 5/1955 | France | 212/57 |
| 853096 | 11/1960 | United Kingdom | 212/64 |
| 861733 | 2/1961 | United Kingdom | 212/57 |
| 971815 | 10/1964 | United Kingdom | 212/46 B |
| 994728 | 6/1965 | United Kingdom | 212/46 B |
| 1119508 | 7/1968 | United Kingdom | 212/64 |
| 208221 | 10/1968 | U.S.S.R. | 212/57 |

*Primary Examiner*—Stephen G. Kunin
*Assistant Examiner*—R. B. Johnson
*Attorney, Agent, or Firm*—Stevens, Davis, Miller & Mosher

[57] ABSTRACT

A rotary tower crane having a tower which can be extended step-wise by adding a section between the boom supporting segment and segments of the supporting structure is provided with a host and crab mechanism for adding or removing a section adjacent to the boom without the use of another crane. The tower is provided with a movable inner tower member slidably disposed in the upper tower segment. The inner tower member has transverse members adapted to be retracted so they will pass bracing members on the tower and to expand to a point where they will support the inner member on the brace members when immediately above the brace members.

5 Claims, 4 Drawing Figures

Fig. 3a
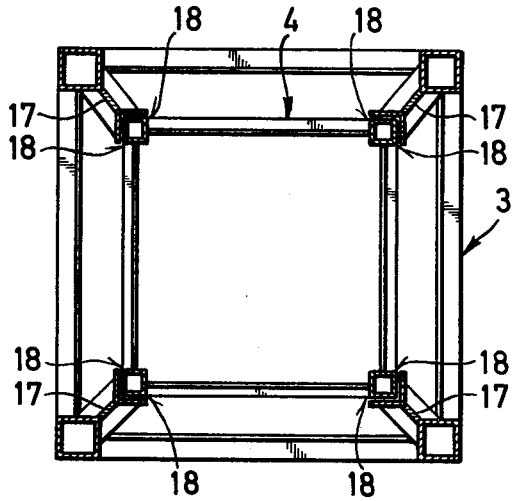
Fig. 3b
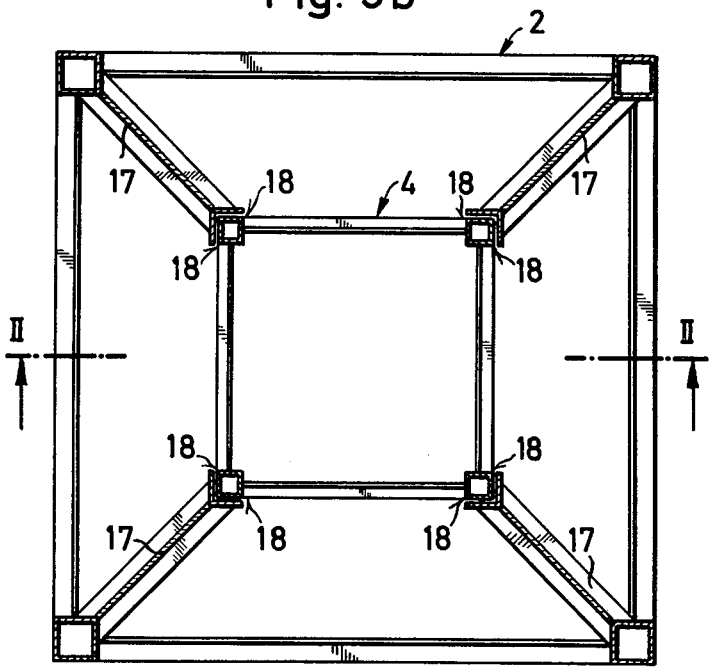
Fig. 3

VERTICAL TELESCOPING LOWER CRANE

CROSS-REFERENCES TO RELATED APPLICATIONS

This is a continuation of application Ser. No. 760,691 filed Jan. 19, 1977, now abandoned which in turn is a Rule 60 continuation of application Ser. No. 547,446 filed Feb. 6, 1975, now abandoned.

This invention relates generally to a rotary tower crane and, more particularly, to an improved rotary tower crane adapted to be extended in a step-wise manner. In U.S. Pat. No. 3,894,635 a rotary tower crane having a tower which can be extended in individual steps is disclosed. In extending the tower, one lengthening section is placed on a guide piece bearing a boom and is guided at the corners by pairs of supports. The added section is positioned on the tower approximately one section length beyond the existing tip of the tower, whereupon an extension section is introduced and detachably connected with the section forming the top of the tower. For the displacement of the guide piece on tower sections of different cross-sectional size pairs of supports, which can be adjusted at three places spaced approximately equally apart above one another, are provided.

In this way, assurance is had that the entire tower can be lengthened or shortened in steps by means of the guide piece without auxiliary devices such as automobile cranes being necessary.

An object of the present invention is to improve upon the above described tower and other rotary tower cranes which have an outer tower and an inner tower movable therein. In such rotary tower cranes the step-wise extending of the outer tower of constant cross-sectional size is effected by mounting an extension section on the existing outer tower top around the inner tower which protrudes therefrom.

The foregoing objects and others are accomplished in accordance with this invention, generally speaking, by providing an elongate boom support structure or tower with a means for adding or removing a section of the boom without the assistance of a crane or other secondary lifting means. A movable elevating means is slidably disposed within the sections forming the tower supporting structure. This elevating means has an upper end provided with an annular track on which the tower head rotates about the longitudinal axis of the tower structure. The lower end of the elevating means is disposed within at least one segment of the tower. The elevating means has a shape corresponding substantially to the cross-sectional shape of the tower sections. A pair of transverse members having latching means for supporting the elevating member on cross-braces of the tower sections are longitudinally spaced from each other and fixed to the elevating member. A fluid actuated piston and cylinder assembly is provided with the piston rod attached to one of the transverse members for moving the elevating means relative to the tower section.

One embodiment of the rotary tower crane of the invention is described by way of example below with reference to the drawing in which:

FIG. 3 shows two FIGS. 3*a* and 3*b* which are vertically spaced sectional views taken along the lines IIIa—IIIa and IIIb—IIIb of FIG. 2 with the lifting device for the inner tower being omitted.

Figure 1:
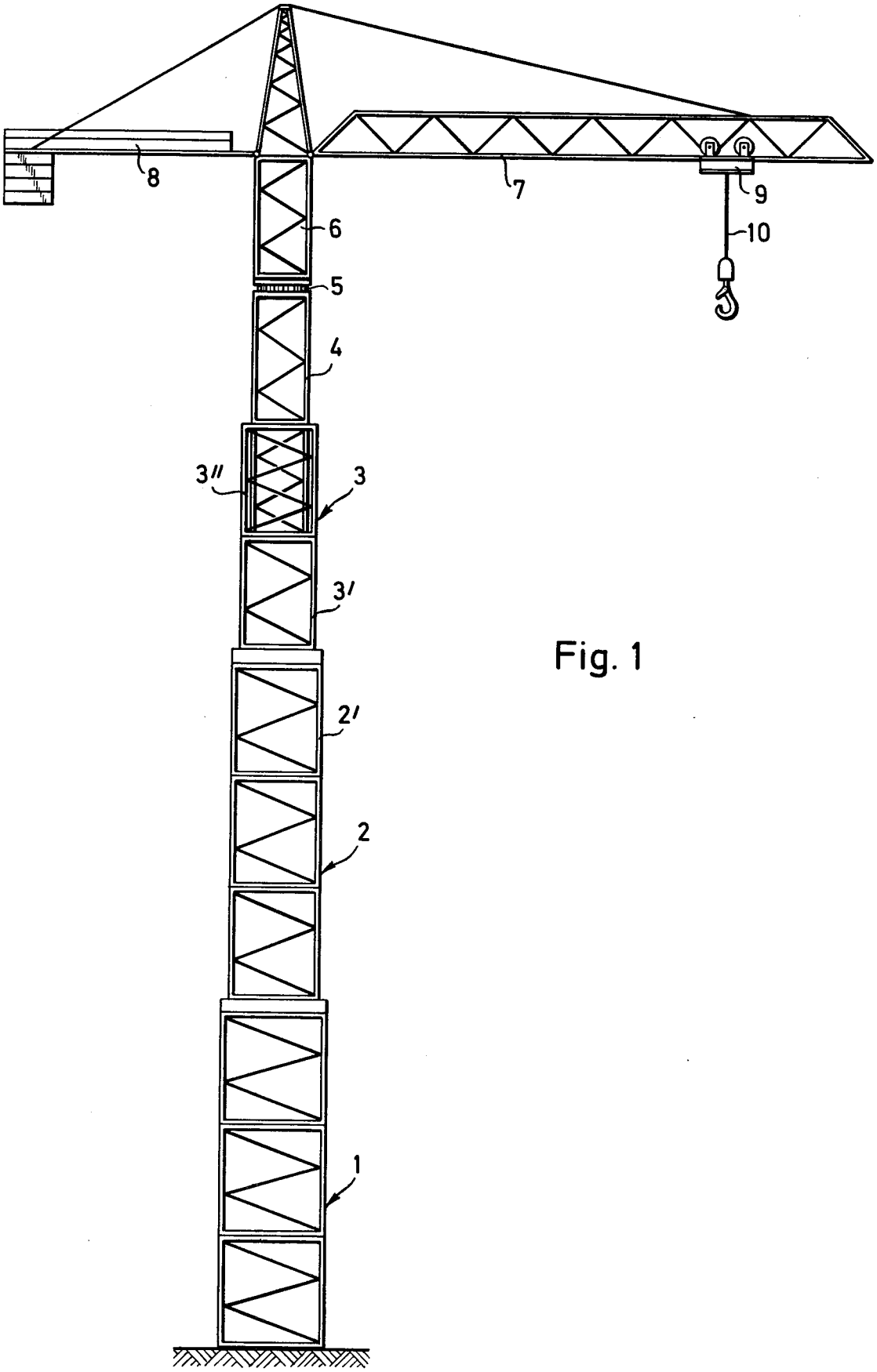
FIG. 1 is a diagrammatic side elevation.

The rotary tower crane of FIG. 1 has a tower with three segments, 1, 2 and 3 of different cross-section each of which is composed of several sections. The lowermost segment 1 of the tower has three sections of largest cross-section, the following central segment 2 of the tower has three sections of smaller cross-section and the following top segment 3 of the tower has two sections of smallest cross-section.

In the upper section of segment 3 an inner tower member 4 is seated. On the upper end of inner member 4 there is a rotary track 5 on which is arranged a tower head 6. Tower head 6 can be turned on track 5 relative to the tower around the common longitudinal axis. To the tower head 6 there are pivoted a boom 7 and a counterweight boom 8 which are clamped fast in horizontal position. A crab 9 with load lifting block 10 is displaceable on the boom 7 in the longitudinal direction thereof.

The inner tower member 4 is displaceable in the direction of the longitudinal axis of the tower at least in the central and uppermost segments 2 and 3 respectively of the tower. When building up the rotary tower crane therefore one first of all places together the sections to tower segment 1, the inner tower 4 and the booms 7 and 8 by means of an automobile crane of relatively small height of boom. The further extending of the tower up to the height of boom desired in the specific case is effected step-wise by means of the inner tower member 4. If the latter is also developed so that it is displaceable in tower segment 1, the latter can also be extended step-wise.

If, for example, the tower of the rotary tower crane of FIG. 1 is to be lengthened by an additional section having the cross-sectional size of tower segment 3, the inner tower member 4 is moved into the position shown in FIG. 1 by about one length of section upward in the tower segment 3 so that the rotary track 5 lies at least approximately one length of section above the upper end of the tower segment 3, but the inner tower member 4 still extends over about one length of section into the tower segment 3. By means of the hoisting block 10 of the crab 9 which is brought against the tower, a first lengthening section part of U-shaped cross-section is first of all placed on tower segment 3 surrounding the inner tower member 4 on three sides whereupon a second plate-shaped extension section part is placed in front of the first extension section part and connected with it so as to produce a closed section which surrounds the inner tower member 4 on all sides and which is detachably connected with the upper end of the tower segment 3. Instead of each extension section consisting of a portion of U-shaped cross-section and a plate-shaped portion, it can also be composed of two parts of L-shaped cross-section. Such extension sections are also known per se.

The taking down of the crane is effected in similar manner in reverse sequence of the operations described.

Figure 2:
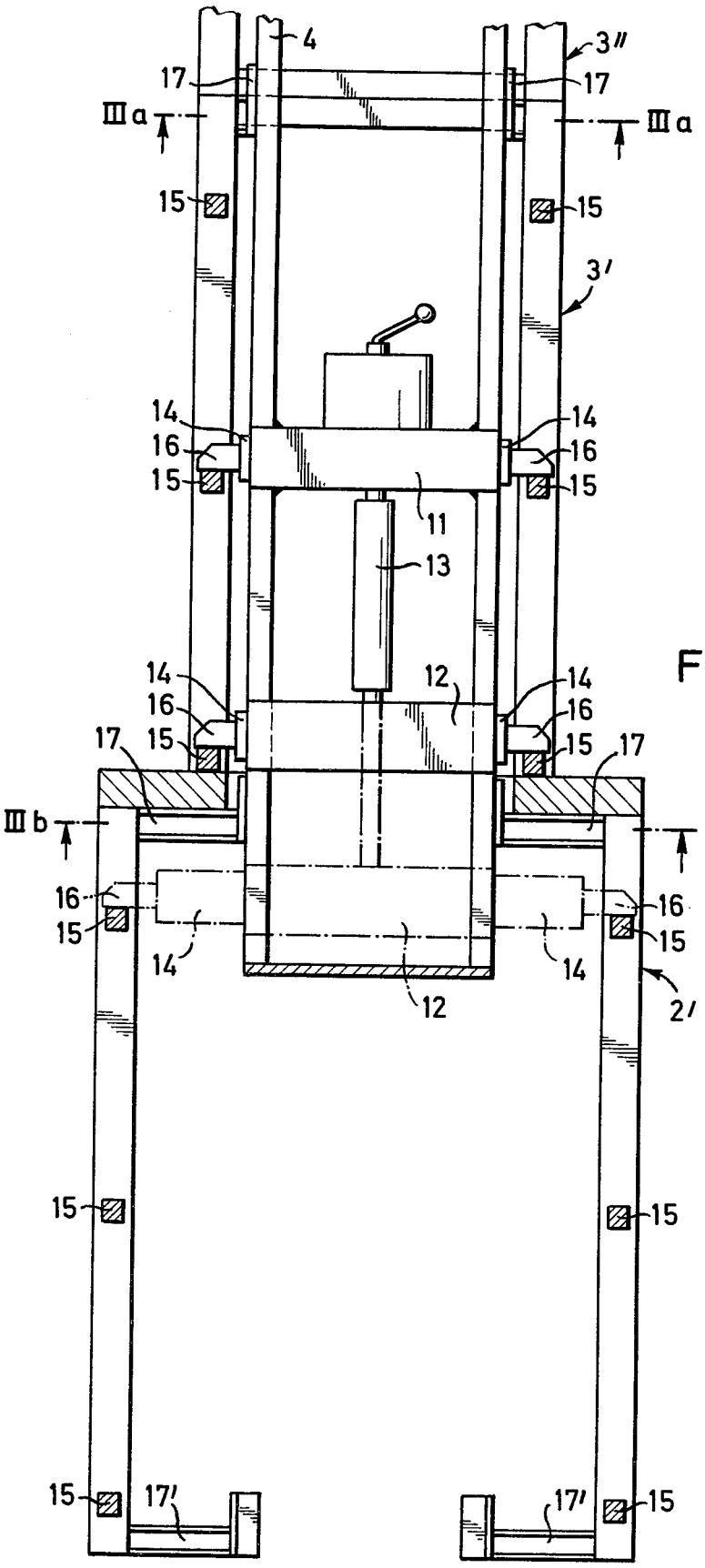
FIG. 2 shows diagrammatically, on a larger scale, the transition from one tower section to the following tower section in the case of the rotary tower crane of FIG. 1.

The inner tower lifting device can be noted from FIG. 2. It has a retaining cross member 11 attached to the inner tower member 4, a lifting cross member 12 and a hydraulic piston/cylinder unit 13 between the retaining cross member 11 and the lifting cross member 12.

Both cross members 11 and 12 have telescoping tower latching ends 14 which cooperate with cross braces 15 spaced apart from each other on respective adjacent sides of the tower, or tower segments, or sections.

If, for instance, the inner tower member 4 is to be pushed upward out of the position shown in FIG. 2, then the latching ends 14 of the lift cross member 12 are pulled in and then also the piston/cylinder unit 13, the inner tower member 4 resting via the retaining transverse member 11 on the central pair of opposite cross-braces 15 of the lowest section 3' of the upper tower segment 3 on which the latches 16 of the latching ends 14 of the retaining cross member 11 lie. These latching ends 14 are retracted so that the retaining cross member 11 has a length corresponding to the cross sectional size of the tower segment 3. As soon as the lifting cross member 12 moves past the lowermost pair of cross braces 15 of the lowermost section 3' of the tower segment 3, the latches 16 of the latching ends 14 move in under spring action and then move out again and come against these cross braces 15, as can be noted from the left-hand half of FIG. 2. If the piston of the cylinder unit 13 is now moved outwardly, the inner tower member 4 moves upward until the retaining cross member 11 moves past the uppermost pair of cross braces 15 of the lowermost section 3' of the upper tower segment 3 and latches to it.

As can be noted from FIG. 2, three such steps are necessary in order to shift the inner tower member 4 by the length of one section. With the position of the inner tower member shown in FIG. 2, the second section 3'' of tower segment 3 can be mounted in the manner described. If the third section of tower segment 3 is to be put on, the inner tower member 4 is moved up by an amount equal to the length of one section in three steps. The retaining cross member 11 then lies with the latches 16 on the central pair of cross braces 15 of the second section 3'' of tower segment 3.

In order to guide the inner tower member 4 in the outer tower or towers, adjustable pairs of supports can be provided as disclosed in U.S. Pat. No. 3,894,635 at three points lying approximately an equal distance above one another, the pairs of supports being arranged on the inside of each corner of the square inner tower member 4, the corners each cooperating with the adjacent corner of the corresponding square tower segments 2 or 3, respectively. It is also possible to provide at each of the three points of each inner tower corner, a pair of supports which cooperates with the adjacent corner of the square tower segment 1 so that a step-wise lengthening of tower section 1 is also possible by means of the inner tower member 4, in which connection the transverse members 11 and 12 are also adjustable to three different lengths corresponding to the cross-sectional sizes not only of the tower segments 2 and 3 but also of the tower segment 1.

In each case those 12 pairs of supports which cooperate with the uppermost tower segment 3 can be arranged in fixed undisplaceable fashion on the inner tower member 4. It is also possible, instead of a separate 12 pairs of supports for each tower segments 1, 2 and 3 respectively, to provide only one set of twelve pairs of supports on the inner tower member 4, each pair of supports being adjustable corresponding to the cross-sectional size of that tower segment 1, 2 or 3 with which it cooperates. The supports of each pair lie vertically under each other.

In the case shown, support shoes 17 are provided instead of the pairs of supports. Each support shoe cooperates with the two outer surfaces 18 of the corresponding corner of the inner tower and is detachably fastened to the tower, for instance, bolted to it. Support shoes 17 of different length are provided for tower segments 1, 2 and 3 respectively. The length corresponds to the distance between fastening points on the tower segments 1, 2 and 3 respectively and the corresponding corner of the inner tower.

The inner tower 4, upon its displacement in the outer tower or towers, must always be guided by at least two sets of four supporting shoes 17, each arranged at a distance apart equal, for instance, to the length of one section. If the lowermost section 3' of tower segment 3 is therefore mounted in accordance with FIG. 2, then the four shorter supporting shoes 17 are applied to the upper end thereof whereupon the inner tower 4 can be pushed into the position shown in FIG. 2. The four lower longer support shoes 17 on the uppermost section 2' of the tower segment 2 can then be removed.

The arrangement of the support shoes 17 on the tower and on the tower segments 2 and 3 respectively, as well as their cooperation with the inner tower member 4, can be noted clearly from FIG. 3.

The tower latching ends 14 of the retaining and lift transverse members 11 and 12 respectively can also be made swingable, for instance, instead of telescoping.

Although the invention has been described in detail for the purpose of illustration, it is to be understood that such detail is solely for that purpose and that variations can be made by those skilled in the art without departing from the spirit and scope of the invention except as it may be limited by the claims.

I claim:

1. A rotary tower crane comprising:

an elongated substantially vertical tower formed of groups of sections detachably secured end to end, said groups being of different transverse cross-sectional area, a detachable section adapted to be added to and removed from the tower to change the height thereof, an inner tower member disposed within the tower which is longer than any detachable section of the tower, said inner tower member having a transverse cross-sectional area less than that of any detachable section of the tower, a tower head with a boom and hoist means thereon disposed on the upper end of the inner tower member, a pair of crossbars fixed to the opposite sides of the tower at each of three points adjacent to the inner tower member, guide means attached to the tower at longitudinally spaced points comprising a strut attached to each corner of the tower and extending inwardly therefrom towards a facing corner of the inner tower member, each strut terminating in a guide member adapted to be disposed about a corner of the inner tower member and prevent lateral displacement thereof as the inner tower member is vertically moved along the longitudinal axis of the tower, means for vertically moving the inner tower member along the axis of the tower a distance at least equal to the length of any detachable section comprising:

a first member rigidly attached to the inner tower member which extends transversely across the inner member, perpendicularly to the said crossbars, means for retracting and extending the first member for adjusting the length thereof to correspond to the cross-section of any section of the tower, retractable latch means disposed on the said retracting means for resting on a pair of crossbars to support the inner tower member on that section of the tower, a second member spaced longitudinally from the said first member and disposed transversely across the inner tower member, said second member being vertically movably connected to the inner tower member, means for retracting the second member for adjusting the length of the second member to correspond to the cross-section of any section of the tower, retractable latch means disposed on the said means for retracting the second member for resting on a pair of crossbars to support the said second member on that section of the tower, and a hydraulic cylinder and piston assembly, said piston being connected at one end to the said second member for vertically moving the second member from one pair of crossbars to the next pair of crossbars, and connected to said first member for moving the inner tower member longitudinally in the tower.

2. The rotary tower crane of claim 1, wherein each guide means is formed of a supporting shoe which rests against the two outer surfaces of the corresponding inner tower corner, the supporting shoe being fastened to the tower.

3. The rotary tower crane of claim 2, wherein the supporting shoe is detachably fastened to the tower so that after a lengthening section has been placed on the tower, the supporting shoes can be removed and the supporting shoes can be arranged on the upper end of the lengthening section.

4. The rotary tower crane of claim 3, wherein the supporting shoes in each case have a length which corresponds to the distance between the point of attachment to the tower and the corresponding inner tower corner.

5. The rotary tower crane of claim 1, wherein the retractable transverse members are each telescoping.

* * * * *